United States Patent [19]

Henderson

[11] 4,372,196

[45] Feb. 8, 1983

[54] INSULATING AND DRAFT PREVENTING AUTOMATIC SHUTTER FOR ATTIC AND OTHER EXHAUST TYPE FANS

[76] Inventor: Donald L. Henderson, 2536 E. 56th Pl., Tulsa, Okla. 74105

[21] Appl. No.: 249,169

[22] Filed: Mar. 30, 1981

[51] Int. Cl.[3] ..... F24F 7/06

[52] U.S. Cl. ..... 98/116; 98/110; 98/121 A; 137/601

[58] Field of Search ..... 98/116, 110, 107, 121 A, 98/88 L; 137/601; 49/89

[56] References Cited

U.S. PATENT DOCUMENTS

| | | | |
|---|---|---|---|
| 1,874,043 | 8/1932 | Ilg et al. | 98/116 |
| 2,571,374 | 10/1951 | Mayr | 98/116 X |
| 3,249,038 | 5/1966 | Johnson | 98/116 |
| 3,964,377 | 6/1976 | Chapman | 98/116 |
| 4,203,566 | 5/1980 | Lord | 98/121 A X |
| 4,217,816 | 8/1980 | Mancinelli | 98/116 |

*Primary Examiner*—William E. Tapolcai, Jr.
*Attorney, Agent, or Firm*—Head, Johnson & Stevenson

[57] ABSTRACT

An insulating cover for the opening of an attic fan or other exhaust type fan and comprising a mounting frame engagable with the inner periphery of the opening, two insulating panels and disposed within the mounting frame and movable between closed and open positions with respect to the opening in response to the activation or deactivation of the fan, a floating inner frame supporting the insulating panel and pivotally secured to an intermediate frame, which is secured to the mounting frame by an offset pivot connection, stop plates provided on the intermediate frame for engagement with the mounting frame to limit the movement of the intermediate frame, stop plates secured to the mounting frame and disposed inboard with respect to the opening for limiting the movement of the insulating panel in one direction, biasing spring member secured between the stop plates and the inner frame for biasing the insulating panels toward a normal closed position and retaining the insulating panels against fluttering in an open position thereof, and sealing members interposed between the mounting frame and the insulating panel in the closed position thereof.

7 Claims, 7 Drawing Figures

INSULATING AND DRAFT PREVENTING AUTOMATIC SHUTTER FOR ATTIC AND OTHER EXHAUST TYPE FANS

BACKGROUND OF THE INVENTION

1. Field of the Invention

This invention relates to improvements in insulating devices and more particularly, but not by way of limitation, to an automatic insulating shutter for attic fans and other horizontally mounted type fans.

2. Description of the Prior Art

Attic fans and other exhaust type fans normally include an exhaust opening through which air is exhausted from an enclosed area. All attic fans are manufactured with a mounting frame and because of their size and considerable weight are normally secured to and rest upon the studs of the ceiling. The closest distance between the horizontal plane of the ceiling where the shutter is attached and the blades of the fan normally does not exceed 10½ inches. The size of the exhaust opening in the ceiling is normally calculated to accommodate the size of the fan's housing frame. Ideally, of course, the fan is designed to operate without any restrictions between the fan blades and the air it evactuates. Therefore, any type of shutter device restricts the efficiency of the fan and encumbers the fan's drive motor. Most, if not, all shutters are manufactured out of very light metal and in a rectangular shape with the lift up panels running across the short side of the rectangle. Since the lift up panels are dependent, one upon the other, by lapping over each other to complete the closure function when the fan is deactivated, they are pivotally attached to one another usually by a bar or bars running the longside of the rectangle so that they may open and close in unison. The lift up panels are enclosed and confined to operate within the mounting frame of the shutter. When the fan is activated the panels lift up in unison into the space above the horizontal plane of the mounting frame of the shutter and the lifting of the panels by the fan is usually assisted by a spring means attached from the mounting frame to the lift up bar. The lift up panels are made to stop substantially short of a full open position to insure that gravity will pull the panels back into a closed position when the fan is deactivated. There are many closure devices for use in combination with the exhaust ports of these fans and which automatically open and close upon the activation of deactivation of the respective fan. Whereas these closure devices have been satisfactory in the past, the current energy problem has increased the importance of reducing loss of warm or cold air through these closure devices. As a result, certain insulating closure assemblies have been developed to reduce the heat dissipation or heat loss through the exhaust openings either from the interior of the enclosed area, or from the exterior thereof. For example, Chapman U.S. Pat. No. 3,964,377, issued June 22, 1976, discloses an insulated closure for attic fans and seals therefor. The Chapman closure includes insulating panels pivotally secured within the attic fan opening and responsive to the draft created by the actuation of the fan for moving to an upwardly extending angular position for permitting the flow of air through the opening. When the fan is deactivated, the panel or panels return to a closed position in the opening. In addition, peripheral sealing members are interposed between each of the panels themselves and the panels and the frame of the opening for precluding the escape of air therebetween in the closed position of the panels. The lift up panels of the Chapman device are just like those on any standard shutter except the addition of insulation material and seal strips, in that they are dependent upon one another by lapping each on the other to complete the closure when the fan is deactivated; they are attached to one another so that they act in unison in opening or closing; they are pivotally secured within and are designed to operate within the confines of the mounting frame of the shutter assembly; when the fan is activated they rise up inside the space above the horizontal plane of the mounting frame; and the panels are stopped short of full opening because of the closure function is solely dependent upon the pull of gravity. In Chapman, therefore, having a given space within the confines of the mounting frame to operate, it follows that as the thickness of the panels is increased in order to accomplish more insulation function than the open air space between each of the panels is correspondently decreased, thereby further restricting the air flow through the fan. In order to afford any reaslistic insulating function in the Chapman device, the panels would have to be made so thick that the corresponding restriction of the air flow between the panels would drastically reduce the efficiency of the fan, and therefore, largely destroy the primary purpose of the fan, that is, to evacuate a desired volume of air. Also these insulating panels do not fully open, and as a result, there is some added restriction in the flow of air through the opening, and in addition, normal draft conditions or pressure differentials across the panels in the closed position thereof, may cause the panel to flutter, and as a result, there is undesirable loss of air therethrough.

Additional insulated closure members are shown in the Mayr U.S. Pat. No. 2,571,374, issued Oct. 16, 1951; the Pfautsch U.S. Pat. No. 2,579,395, issued Dec. 18, 1951; and the Koch U.S. Pat. No. 2,580,797, issued Jan. 1, 1952. These patents all disclose a hinged flapper member adapted to engage the outer end of a draft opening of a ventilating duct, the hinged flapper being of an insulating type. However, these flapper members are mounted in a vertical position; do not provide a substantial full opening; are made to operate entirely outside the confines of duct; and do not employ the use of an intermediate frame to allow the flapper to extend into and outside of the duct when the fan is activated. In the case of the Mayr and Pfautsch devices, and the flapper of the Koch device is provided with manual means for overcoming the biasing spring in order to open the flapper. Still another patent, namely the Emmert U.S. Pat. No. 2,367,265, shows a ventilation port installed as an auxiliary feature to a window, the ventilation port having louvers provided therein which may have insulating inserts provided. These louvers may be opened and closed manually, or the like, when it is desired to ventilate an enclosed area, or open the area to the atmosphere.

SUMMARY OF THE INVENTION

Keeping in mind that the desired result is to produce an automatic closure device or shutter that substantially insulates and stops drafts through the attic fan assembly, an analysis of this device will reveal that by using an intermediate frame, the lift up insulating panels are so fixed that they lie partially outside the confines of the mounting frame in the closed position, and, when the fan is activated, the insulating panels not only rise up into the space above the horizontal plane of the mounting frame but also extend below the horizontal plane of the frame. By permitting the insulating panel to extend below as well as above the horizontal plane of the frame this allows this device to use only one insulating panel of any given thickness to cover and insulate an area that would require at least two insulating panels on any other shutter, including Chapman, and reduces by half the restrictions of air to the fan created by the panels. The present invention contemplates a novel insulated shutter for attic fan openings, and the like, which automatically responds to the draft created by the actuation of the fan for opening to exhaust air from an enclosed area, or the like, and automatically closes upon deactivation of the fan. The insulated shutter includes a mounting frame adapted for installation in the exhaust port or opening of an attic fan, or the like, and at least one insulating panel or shutter means pivotally secured therein for automatic response to the draft of the operating fan for moving to a substantial full open position to permit a maximum flow of air through the port. The panel automatically returns to a sealed closed position upon deactivation of the fan. A floating inner frame supports the insulating panel within the opening and is pivotally secured to an intermediate frame means having an offset pivot connection with the mounting frame. The offset pivot connection of the intermediate frame means in combination with the floating feature of the inner frame means provides for a substantially full open position of the insulating panel because as the insulating panel is forced to rise when the fan is activated, the intermediate frame is caused to extend downward pulling the insulating panel also downward to a stopping point where slightly less than half of the insulating panel is below and slightly more than half is above the horizontal plane of the mounting frame, and sealing means is interposed between the insulating panel and the mounting frame means to provide said sealing of the panel in the closed position thereof. In addition, a stop means is provided in the mounting frame for limiting the movement of the panel in one direction, and suitable helical spring means is secured between the stop means and the insulating panel to assist gravity in the closing function and for holding the shutter assembly firmly against any fluttering action in both the open and closed positions thereof. The novel insulating shutter assembly is simple and efficient in operation and economical and durable in construction.

DETAILED DESCRIPTION OF THE PREFERRED EMBODIMENTS

Figure 1:
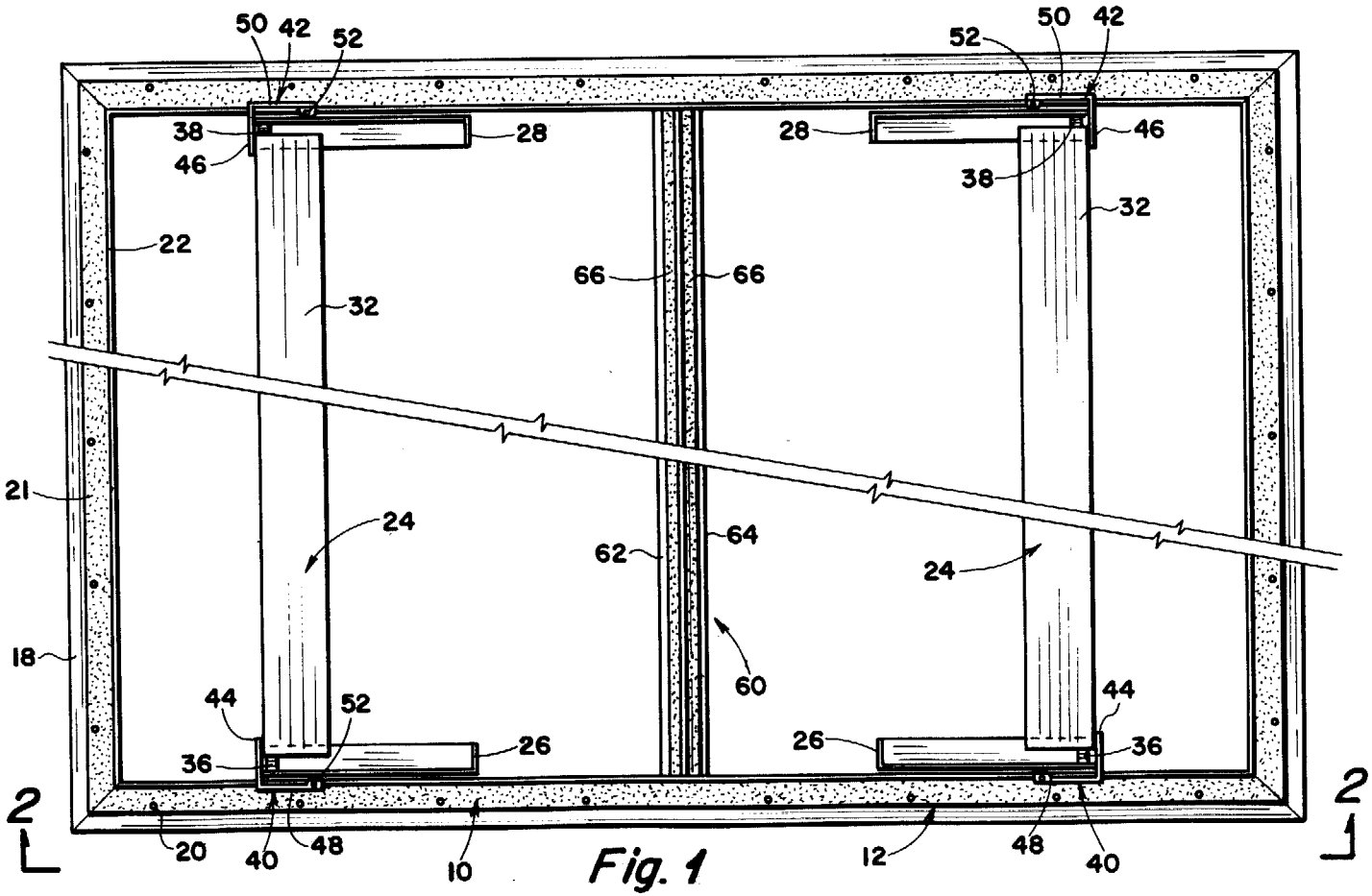
FIG. 1 is a top view of an insulated shutter assembly embodying the invention and illustrated in a full open position.

Referring to the drawings in detail, reference character 10 generally indicates an insulating shutter assembly having an outer mounting frame 12 adapted for installation in the usual exhaust port or opening 14 provided in a wall or ceiling 15, for any suitable exhaust fan, such as an attic fan 16, or the like. The mounting frame 12 may be of any suitable construction, and as shown herein, comprises an open frame or plate 18 of a configuration corresponding to the configuration of the opening 14. The outer dimensions of the frame 18 are preferably slightly larger than the dimensions of the opening 14, whereby the frame or plate 18 may be secured to the outer face of the wall 15 in the proximity of the opening 14 in any suitable manner, such as by a plurality of spaced bolts 20, or the like. It is also preferable to provide a suitable sealing gasket 21 between the outer face of the wall 15 and the inner face of the plate 18 for precluding leakage of air therebetween. It is to be noted that the bolts or screws 20 may be utilized for sandwiching the sealing gasket 21 between the plate 18 and the wall 15, as well as for securing the plate to the wall. The inner dimensions of the plate 18 are slightly less than the dimensions of the opening 14, and an outwardly extending housing 22 is provided around the inner periphery of the plate 18, said housing having a configuration corresponding to the configuration of the opening 14 for insertion therein.

At least one panel or louver assembly 24 is pivotally secured within the housing 22 and includes an intermediate frame means comprising a pair of oppositely disposed channel members 26 and 28 pivotally secured to the inner periphery of the housing 22 and disposed in substantial alignment. It is to be noted that two of the louver assemblies 24 are shown herein, but it is to be understood that substantially any desired number of the louvers 24 may be provided. Each assembly 24 is substantially identical, but in the embodiment depicted herein, the two assemblies are oppositely disposed with respect to one another and the detailed description of only one louver will be set forth herein.

Figure 2:
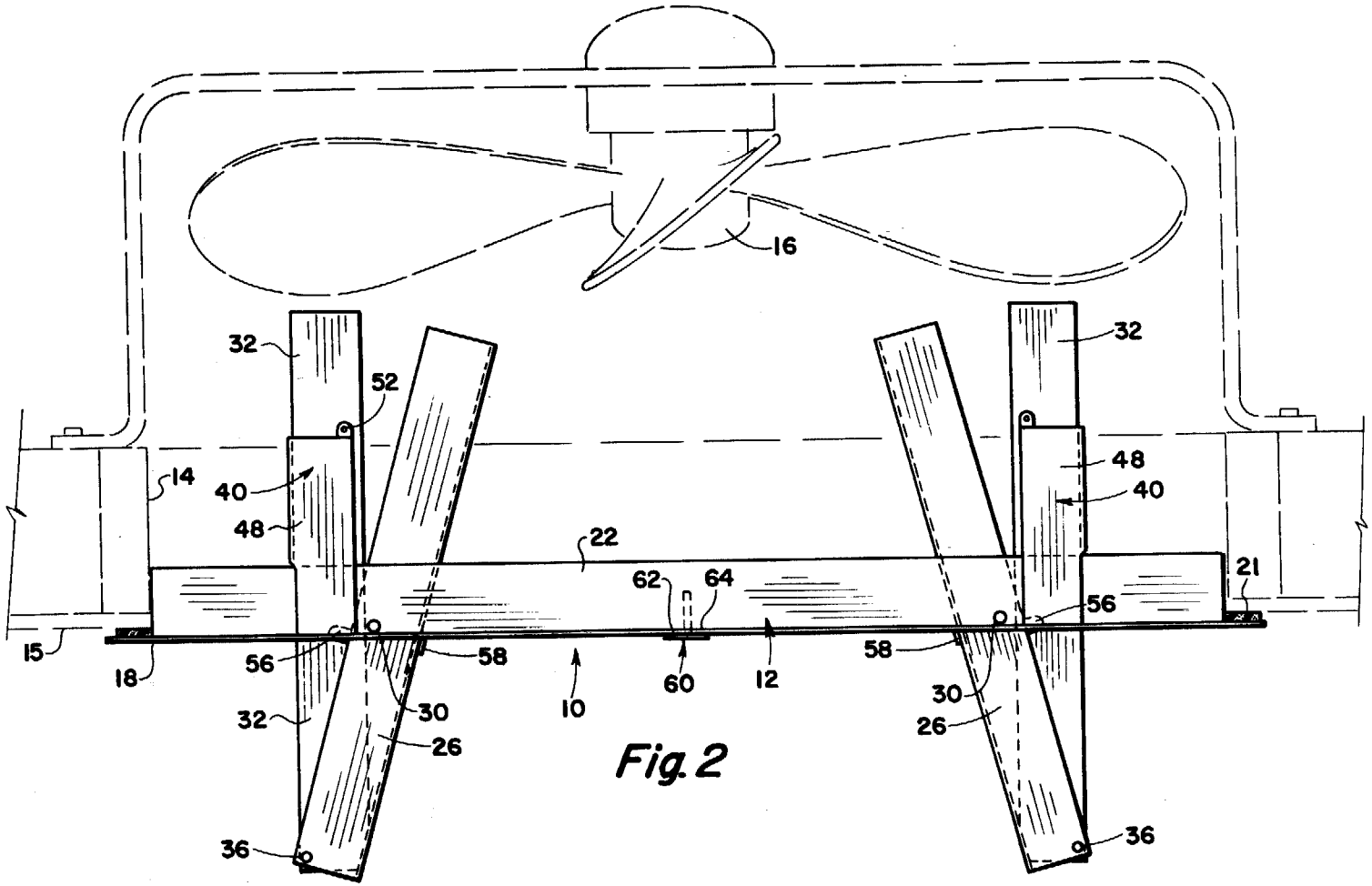
FIG. 2 is a view taken along line 2—2 of FIG. 1, with portions shown in broken lines for purposes of illustration.
Figure 3:
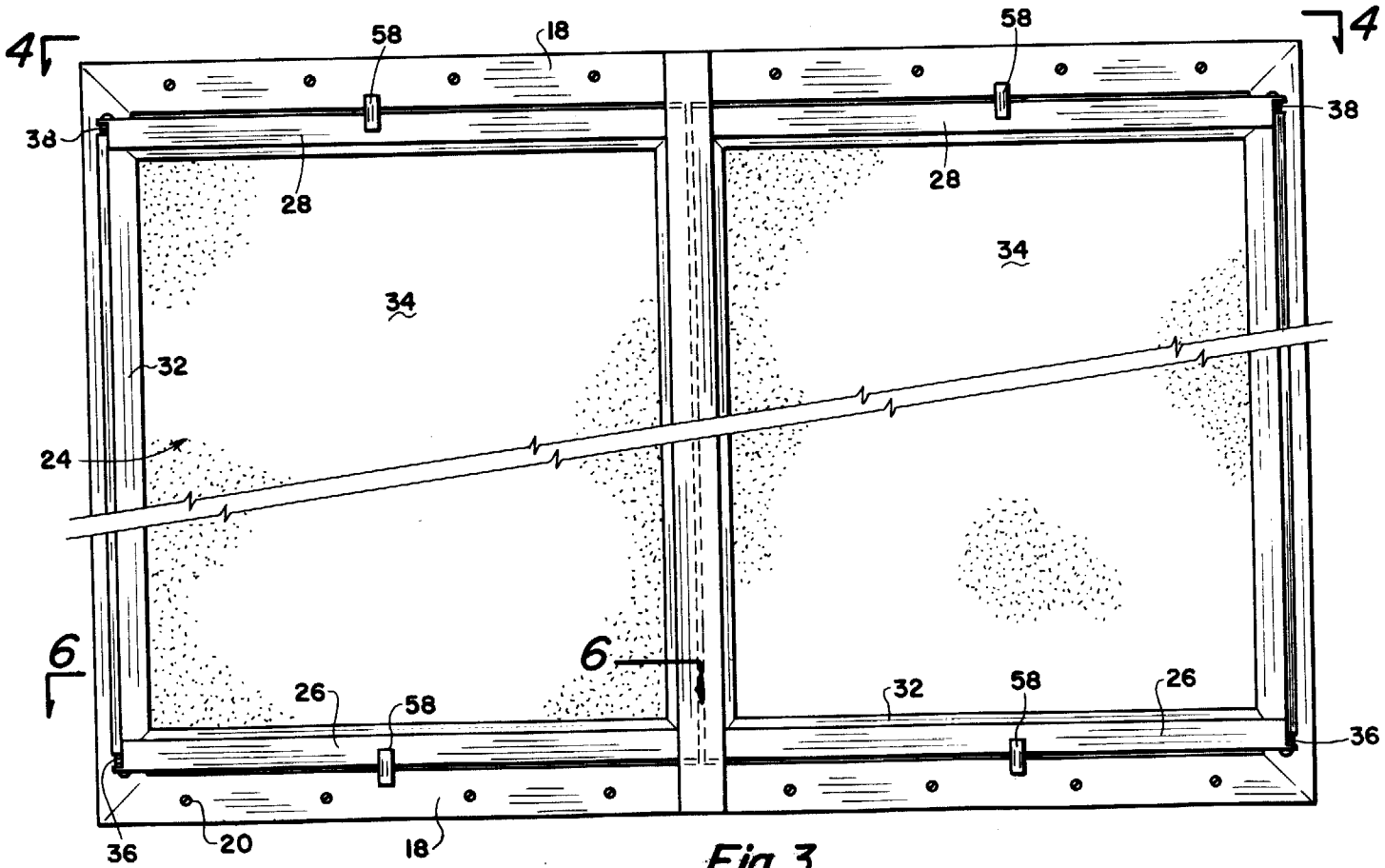
FIG. 3 is a bottom view of an insulated shutter assembly embodying the invention and illustrated in a closed position.
Figure 5:
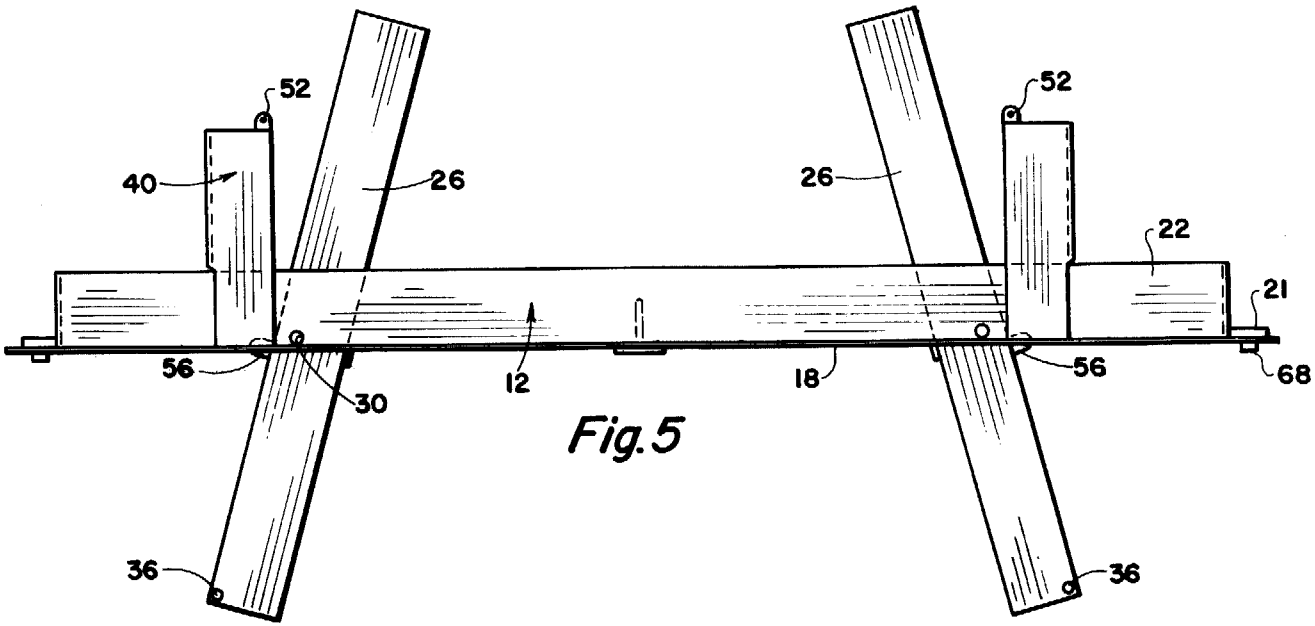
FIG. 5 is a view similar to FIG. 4 illustrating an insulated shutter embodying the invention in an intermediate position between a full open and full closed position.

The channel members 26 and 28 are pivotally secured to the housing 22 by similar offset pivot connections 30 for a purpose as will be hereinafter set forth. A floating inner frame means 32 of an open framework construction is interposed between the channels 26 and 28 and an insulating panel member 34 is suitably supported within the frame 32. The panel member 34 is preferably constructed of a styrofoam material, but not limited thereto. The inner frame means 32 is pivotally secured to each channel member 26 and 28 by suitable axially aligned pivot pins or connection members 36 and 38, respectively, in such a manner that the pivot connection therebetween is in the proximity of the lower ends thereof as viewed in FIGS. 2, 5 and 7 for a purpose as will be hereinafter set forth.

Figure 6:
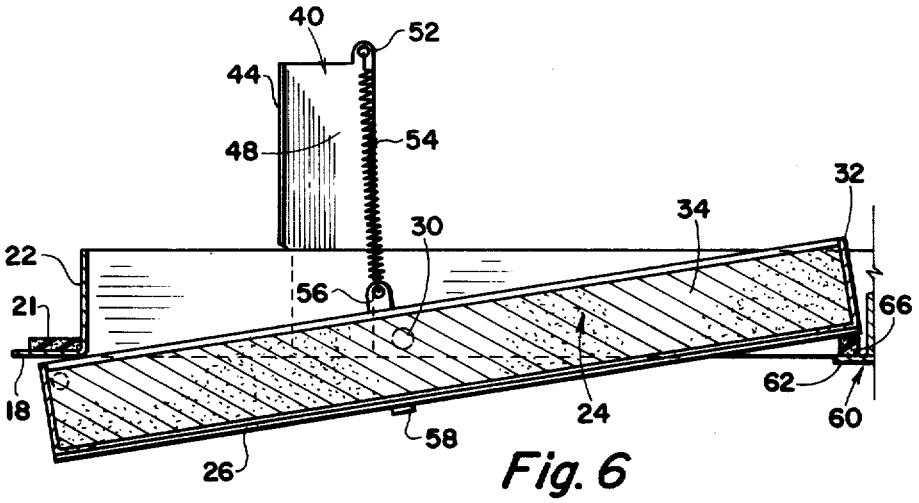
FIG. 6 is a view taken on line 6—6 of FIG. 3.

A pair of substantially identical oppositely disposed stop plates 40 and 42 of substantially L-shaped cross sectional configuration are secured to the housing 22 in any suitable manner (not shown) in slightly spaced relation with respect to the pivot connections 30. One leg 44 and 46 of each stop plate 40 and 42, respectively, extends inwardly from the housing 22 for limiting the rotational movement of the panel or louver 24 in one direction. The other leg 48 and 50 of each stop plate 40 and 42, respectively is provided with a tab member 52 for receiving one end of a suitable helical spring 54 for anchoring thereof. The opposite end of each spring 54 is similarly anchored on a suitable tab member 56 provided on the inner frame means 32, as particularly shown in FIGS. 6 and 7. In addition, a stop member 58 is provided on each channel member 26 and 28 oppositely disposed with respect to the tab members 56 for a purpose as will be hereinafter set forth.

Figure 4:
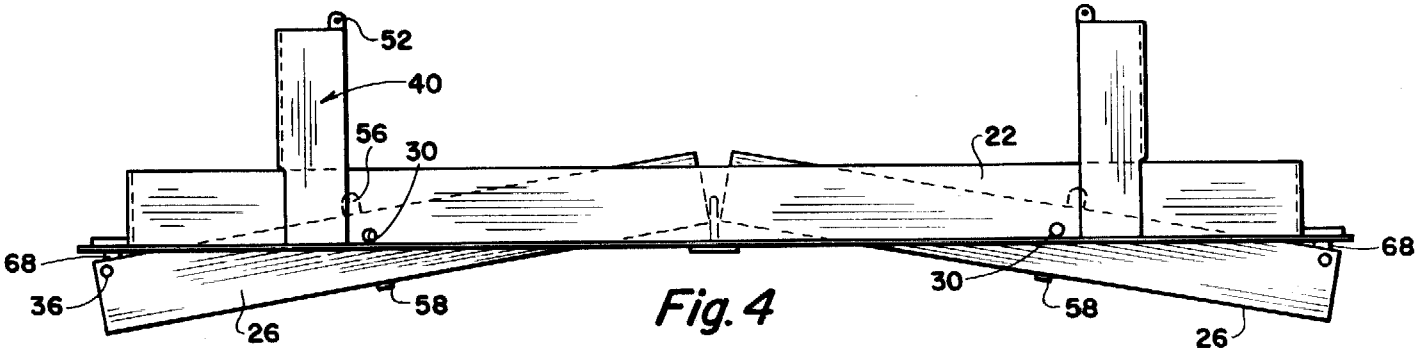
FIG. 4 is a view taken on line 4—4 of FIG. 3.

In the event two or more of the louver assemblies 24 are provided or mounted within the housing 22, it is desirable to provide a transversely extending stop means 60 spanning the distance between the sides of the housing 22. The stop means 60 may be of any suitable configuration and as shown herein is preferably of a substantially T-shaped cross sectional configuration providing a pair of oppositely disposed outwardly extending flanges or ledges 62 and 64. A suitable sealing strip 66 is secured along the inner surface of the ledges 62 and 64 for receiving one edge of the respective louver 24 thereagainst to support the louver 24 in the closed position thereof as well as provide a sealing engagement therebetween. It is also preferable to provide similar sealing strips 68 on the outer face of the plate 18 and spaced outboard of the opposite ends of the housing 22 as particularly shown in FIGS. 4 and 5 to provide a sealing engagement between the outer ends of the louvers 24 in the closed position thereof.

In operation, the shutter assembly 10 may be installed in the opening 14 as hereinbefore set forth, with the plate 18 being disposed against the outer wall 15 and around the outer periphery of the opening 14. The opposite ends of the louver assemblies 24 are normally disposed in the channels 26 and 28, and the spring 54 constantly urge or bias the louvers 24 toward the closed position therefor, since the connection of the springs 54 with the tabs 56 is spaced slightly outboard with respect to the pivot connections 30, as will be particularly seen in FIGS. 6 and 7. In this closed position for the louvers 24, the opposite ends thereof will be sealed from leakage of air therearound by the sealing strips 66 and 68. In addition, the force of the springs 54 substantially preclude any fluttering action of the louvers due to any natural draft conditions at the opening 14, or any pressure differentially acting on the opposing faces of the louvers. Thus, an efficient sealing is provided at the opening 14 in the closed position of the apparatus 10. In addition, the insulating nature of the material from which the panels 36 are constructed greatly reduces any loss of heat or cold through the louvers in the closed position thereof.

Figure 7:
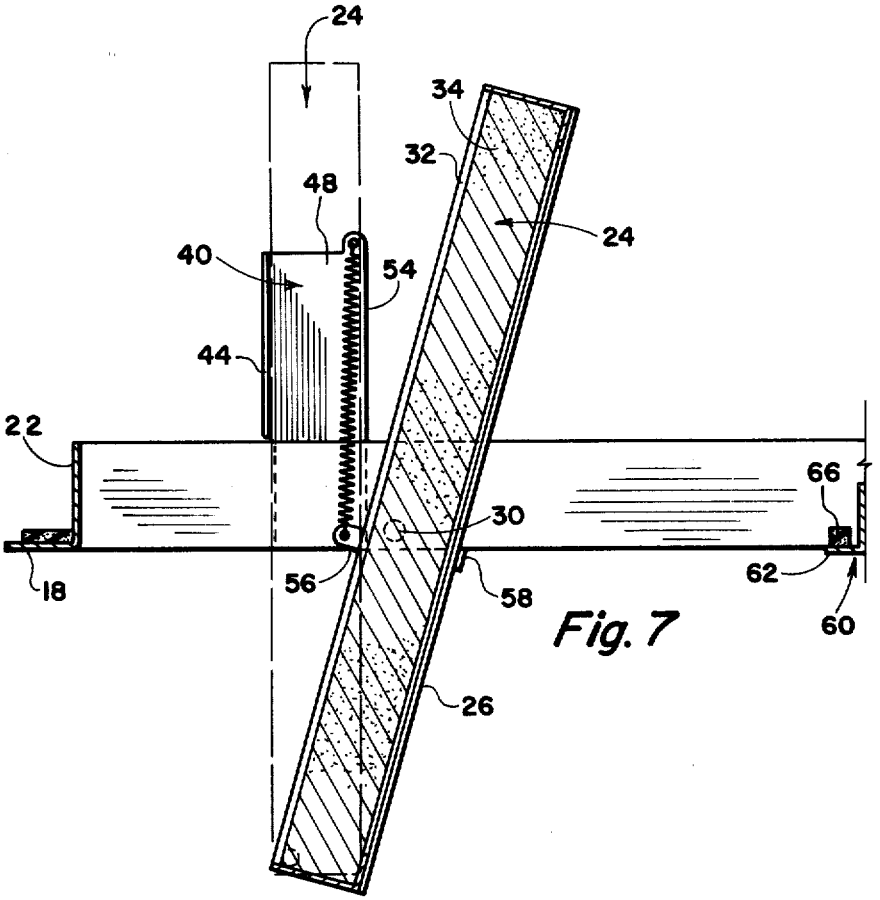
FIG. 7 is a view similar to FIG. 6 illustrating an insulating shutter embodying the invention in an intermediate position in solid lines and a full open position therefore in broken lines.

When the fan 16 is activated, the suction or draft created at the opening 14 causes the louvers 24 and channels 26 and 28 to pivot about the pivot connections 30 to the position shown in solid lines in FIG. 7. At this position, the stop members 58 engage the plate 18 and preclude any further movement of the channels 26 and 28 in the opening direction. The springs 54, however, act on the louver assemblies 24 for pivoting thereof about the pivot connections 36 and 38 whereupon the louvers move to an almost full open position therefor as shown in broken lines in FIG. 7. Continued movement of the louvers in the opening direction is limited by the engagement thereof with the legs 44 and 46 of the stop members 40 and 42, respectively. The force of the springs 54 maintain the louvers 24 in a firm engagement with the legs 44 and 46 to substantially preclude any fluttering action of the louvers in the open position thereof.

Of course, as soon as the fan 16 is deactivated, and the draft or suction force no longer acts on the louvers 24, the springs 54 assisting the pull of gravity immediately return the louvers to the closed position thereof. As the louvers move from the full open position and toward the full closed position, the engagement between the louvers and the intermediate frame or channels 26 and 28 is reinstated and the louvers and channels move to the closed position as a unit.

From the foregoing, it will be apparent that the present invention provides a novel insulating shutter for the exhaust openings of attic fans, or the like, wherein insulated louver members are automatically moved to an almost full open position upon activation of the fan and returned to a closed position upon deactivation thereof. In the closed position of the louvers, seal means substantially preclude leakage of air therearound, and biasing means maintains the louvers in the closed position for substantially precluding fluttering of the louvers due to pressure differentials acting thereon. Similarly, the biasing means maintains the louvers in the full open position for substantially precluding fluttering thereof. The louvers are constructed from an insulating material for cooperating with the peripheral sealing means to greatly reduce loss of either hot or cool air through the exhaust opening, thus conserving energy.

Whereas the present invention has been described in particular relation to the drawings attached hereto, it should be understood that other and further modifications, apart from those shown or suggested herein, may be made within the spirit and scope of this invention.

What is claimed is:

1. An insulating and draft preventing automatic shutter for the air intake opening of an exhaust fan and comprising a horizontally positioned mounting frame means adapted for installation in the opening, insulating louver assembly means pivotally disposed within the mounting frame and automatically movable by the flow of air between open and closed positions in response to activation and deactivation of the fan the louver assembly means comprising oppositely disposed channel members pivotally secured, at a point between the ends of the channel members, to the mounting frame; an inner frame means composed of an insulating panel member, positioned within the channel members and pivotally secured thereto at the proximity of one end of both the channel members and the inner frame means which will be upstream of the flow of air through the mounting frame when in the open position; and means during the open position to preclude pivotation of the channel members to a position substantially transverse to the mounting frame, yet permit pivotation of the inner frame to a position substantially parallel to the flow of air through the mounting frame.

2. An insulating and draft preventing automatic shutter as set forth in claim 1 and including stop means secured to the mounting frame means for limiting movement of the inner frame means in the open position thereof.

3. An insulating and draft preventing automatic shutter as set forth in claims 1 or 2 including means normally biasing the channel member to the closed position.

4. An insulating and draft preventing automatic shutter as set forth in claims 1, or 2 wherein the pivotal connection between the channel members and the mounting frame means is offset with respect to the center of the channel members such that a greater length extends from the pivotal connection downstream of the flow of air than the length that extends upstream.

5. An insulating and draft preventing automatic shutter as set forth in claims 1 or 2 wherein the louver assembly means is at least two in number.

6. An insulating and draft preventing automatic shutter as set forth in claims 1 or 2 and including transversely extending stop means provided on the mounting frame means and interposed between adjacent edges of the inner frame means to provide a sealing surface for receiving the said edges thereagainst in the closed position.

7. An insulating and draft preventing automatic shutter as set forth in claims 1 or 2 including means normally biasing the channel member to the closed position, and wherein the pivoted connection between the channel members and the mounting frame means is offset with respect to the center of the channel members such that a greater length extends from the pivotal connection downstream of the flow of air then the length that extends upstream.

* * * * *